United States Patent [19]

Fundell

[11] Patent Number: 4,911,097

[45] Date of Patent: Mar. 27, 1990

[54] SHORT DWELL APPLICATION WITH BIG EXCESS PASTE AMOUNT

[76] Inventor: Yngve Fundell, Bergsliden 4, S-162 40 Vallingby, Sweden

[21] Appl. No.: 33,155

[22] PCT Filed: Jul. 7, 1986

[86] PCT No.: PCT/FI86/00076

§ 371 Date: May 4, 1987

§ 102(e) Date: May 4, 1987

[87] PCT Pub. No.: WO87/00091

PCT Pub. Date: Jan. 15, 1987

[51] Int. Cl.[4] ..... B05C 5/02

[52] U.S. Cl. ..... 118/410; 118/413

[58] Field of Search ..... 118/410, 413

[56] References Cited

U.S. PATENT DOCUMENTS

| | | | |
|---|---|---|---|
| 3,518,964 | 7/1970 | Nagler | 118/410 X |
| 4,396,648 | 8/1983 | Holt et al. | 118/410 X |
| 4,452,833 | 6/1984 | Holt | 118/410 X |
| 4,594,963 | 6/1986 | Krautzberger | 118/410 X |
| 4,791,879 | 12/1988 | Eklund et al. | 118/410 |

FOREIGN PATENT DOCUMENTS 2055405 10/1973 Fed. Rep. of Germany ..... 118/413

*Primary Examiner*—Shrive Beck
*Assistant Examiner*—Alain Bashore
*Attorney, Agent, or Firm*—Dellett, Smith-Hill and Bedell

[57] ABSTRACT

Arrangement for the coating of a running web (2), for instance a paper, a cardboard or a like web, by means of a so-called short dwell applicator (18), in which the paste supply, the paste doctoring and levelling of the supplied coating layer are carried out in the same arrangement and the amount of the excess supplied paste is collected for a recirculation. The arrangement comprises a rear edge seal (9, 12) and fore distributor (6, 15) so arranged that the coating paste is supplied on the web there, where the last quoted arrives in the arrangement, and then the paste flows mainly in the direction (22) of the material web (2) until it meets a doctor (3). The amount of supplied paste (1) is big compared to the amount of paste, which attached and levelled follows along with the running material web (2).

13 Claims, 4 Drawing Sheets

SHORT DWELL APPLICATION WITH BIG EXCESS PASTE AMOUNT

BACKGROUND OF THE INVENTION

The invention relates to an arrangement for the coating of a running material web.

Paper, cardboard etc. are normally produced from natural cellulose fiber. The paper production is a complicated process, which is started by the defibration of natural logs or other plant parts, fibre preparation and finally sheet formation. In the sheet formation one strives to distribute the fibers so evenly as possible. Along with the dewatering, which is carried out by the sheet formation, the fibers are guided more near to each other and are linked, mainly through fluidum bonds.

The paper comprises fibres located in several layers, arbitrarily distributed. If one examines the paper through a magnifying glass, cavities are found between the fibers and the surface is found uneven - everything depending on the micro structure quoted above.

One might have different reasons for the desire to improve this uneven micro structure. One might have, for instance, the desire to reduce the porosity in the paper, in order to be able to apply it as packaging material. Or, it is also important to improve the paper surface itself, in order to be able to print on the paper with a good result. A common method for the surface levelling and the porocity reducing is the application of a layer on the top of the completed paper surface. A normal method is to mix finely divided pigment, for instance clay, to supply this paste on the paper web. The surface smoothness is realized in that one doctors the paste by a trowel blade, a so called scraper knife. The doctored paper is hereafter dried, whereby the supplied paste is attached at the paper web through a certain penetration.

A normal coating method is the guiding of the paper web through a nip located between two drums, in which the paste is supplied by the partial immersion of the other drum in a machine bin filled with paste. The paste excess is doctored off hereafter at a certain distance from the nip and the paste is levelled by a scraper knife. The drum nip can also be replaced by a fountain or a so-called applicator.

Normal web speeds are 600–1000 m/min but even higher speeds, up towards 2000 m/min are applied. The paste excess during the doctoring is hereby often 10–20 ggr. This excess amount is resupplied in to a trough for the return to the machine bin.

A nip method has been developed during the past years, which combines the fountain application and the doctoring in to one member the so-called short dwell technique. A benefit hereby is the short distance between the paste application and the doctoring.

The so far constructed short dwell appliances comprise a defect, which is the minor paste excess amount realized. This is a result of the applied technique, in which the eventual paste excess amount must be compressed out at the rear wall *against* the running direction of the paper web. This results even in a prolonged penetration extent than was intended for.

SUMMARY

The object of the invention is to realize a development of the familiar short dwell appliances so, that the amount of the paste excess, which is supplied on the web, can be increased. An object is also to realize an application with a favourably short penetration extent.

A further object is to create an arrangement in which the application paste flow is smoothly arranged in the application arrangement and air bubbles in the paste can be separated before the paste reaches the running web.

In accordance with the invention, a big amount, in comparison to that paste amount attached at the web, of application paste is supplied on the web in the application chamber. The application chamber is divided by a distributor in an inlet and an exit channel. The paste is supplied on the web thereat, where the latter arrives in the application chamber, after which the paste follows along with the web to a doctor, which forms the front wall of the chamber, at which the excess paste is removed and guided in to the exit channel of the application chamber, for a resupply in the process. The application of the paste with a normal paste excess amount can be done in an arrangement according to the invention. By this means a so-called skip-coating, among other things, is avoided, that is, uncoated surfaces on the paper web.

The doctor at the front edge of the application chamber is, according to a preferred embodiment, a so-called downstreams inclined scraper knife, which forms a sharp angle relative to the running web, in the web running direction. An alternative embodiment comprises an upstreams inclined scraper knife of that type which is described in the Swedish Patent Application Nr. 8503345-4. A benefit within this embodiment lies in that one avoids those rheology phenomena, which are generated with a "downstreams" scraper knife. Furthermore, a free exit is realized for the recycle paste.

That gap which unavoidably must be found at the rear edge of the application chamber, can be made quite small, that is, a gap so big only is left which is necessary for a free passage of the paper. Furthermore, this gap can be provided with, for instance, a small roll, in order to prevent a reverse paste flow. Other appliances can even be imagined for the prevention of the paste reverse flow. By such means an increased pressure can be available in the space, in which the application of the paste is carried out.

BRIEF DESCRIPTION OF THE DRAWINGS

The invention is described more in detain with reference to the attached drawing in which.

DESCRIPTION OF THE PREFERRED EMBODIMENTS

Figure 1:
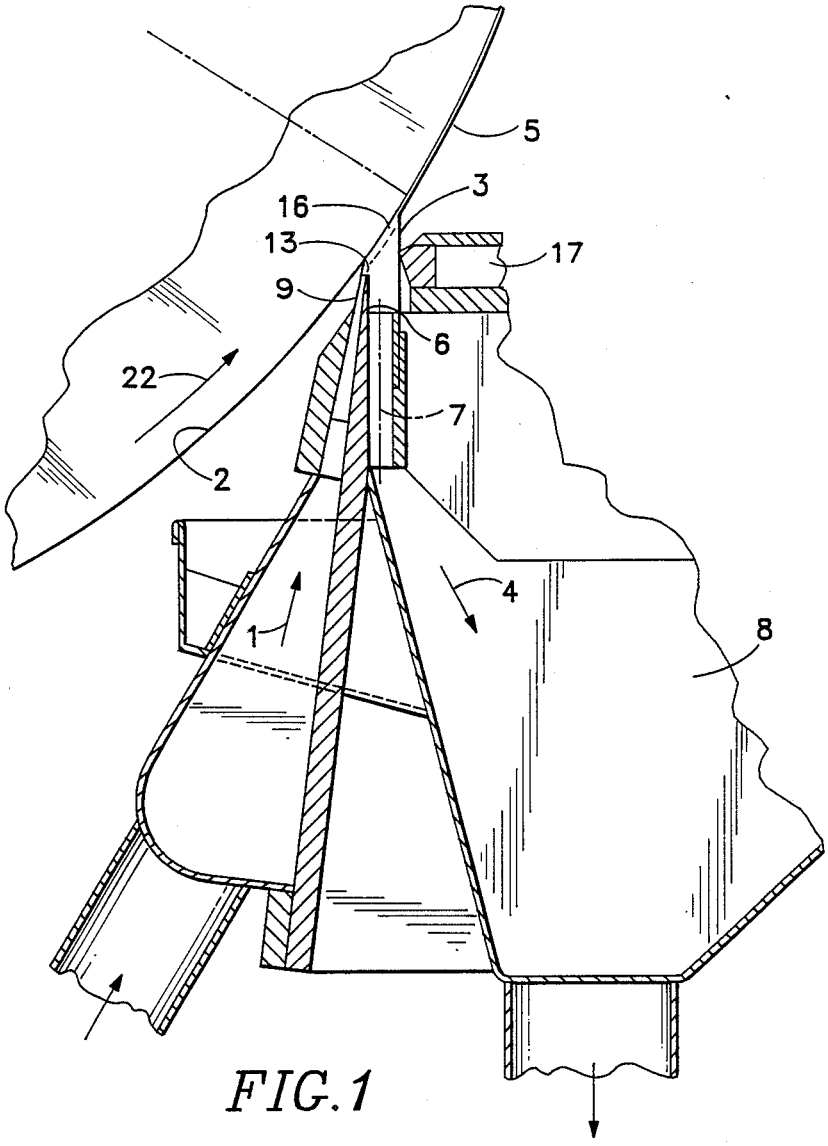
FIG. 1 illustrates an embodiment of the invention in a side view.

The reference numeral 5 in the drawing refers to a guide or support drum rotating in the rotation direction 22, which carries a running material web 2. Reference 1 refers to a flowing paste amount which enters the application arrangement through an inlet channel thereof. Reference 9 refers to a rear edge seal of the application chamber, which in the embodiment according to FIG. 1 comprises a knife. Reference 6 refers to a distributor in the application chamber which divides the interior extent of the chamber in an inlet channel and an exit channel 7. Between the front edge of the distributor 6 and the running web is located a gap 13, through which the application paste flows. Reference 3 refers to a doctor, for instance a scraper knife, which by means of an appliance 17 is compressed against material web 2. Application paste 1 is supplied on web 2, in the described arrangement, in the application chamber at that location, at which web 2 enters the application chamber at rear edge seal 9. A big amount of paste 16 is supplied hereat on web 2, and follows along with it all the way to doctor 3, whereat the excess amount is removed and the surface is levelled for the realization of the desired coating layer 5 on the web. The removed excess amount streams hereafter through channel 7 in to a collector container 8 for a resupply in the process. Thus, by means of the described arrangement one realizes a smooth and continuous flow of the coating paste in the arrangement, through that also the penetration extent is kept favourably short in the arrangement.

Figure 2:
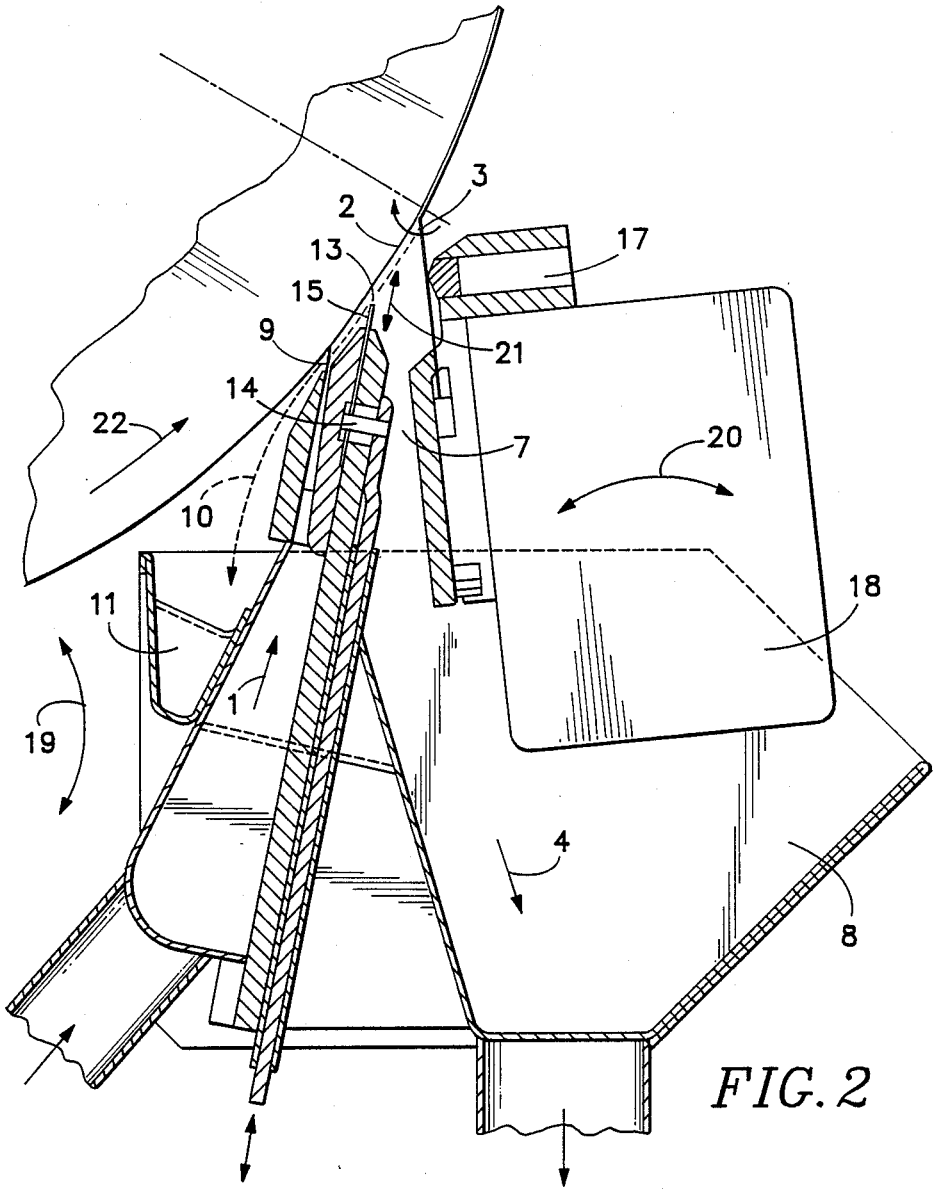
FIG. 2 illustrates another embodiment of the invention in a side view.

In the embodiment according to FIG. 2, distributor 6 is replaced by a distributor 15, which is movable in a direction 21 for the adjustment of gap 13 through an appliance 14. The minor amount of excess paste amount 10 in the reverse flow direction, which penetrates through rear edge seal 9, is collected in a container 11. The entire arrangment 18 is turnable in a direction of arrow 20, and hoistable and descendable in a direction of arrow 19, also.

Figure 3:
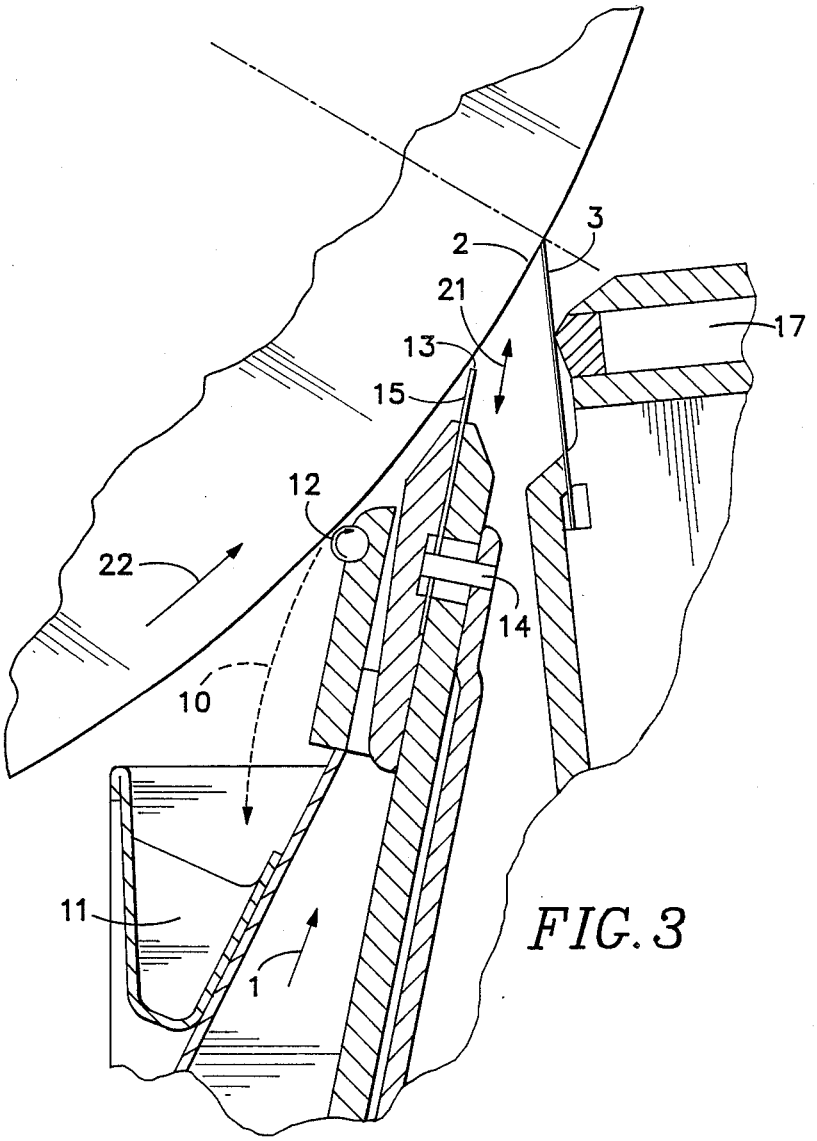
FIG. 3 illustrates a third embodiment of the invention in a side view.

In the embodiment according to FIG. 3, rear edge seal 9 is replaced by a roll 12 arranged rotatably, for a further reduction of the paste amount 10 in the reverse flow direction. The roll 12 may be freely rotatable, or alternatively it may be driven so that its surface moves in the direction of movement of the web. The speed of rotation of the roll in the case that it is driven may be such that the peripheral speed of the roll is the same as or different from the speed of the web.

Figure 4:
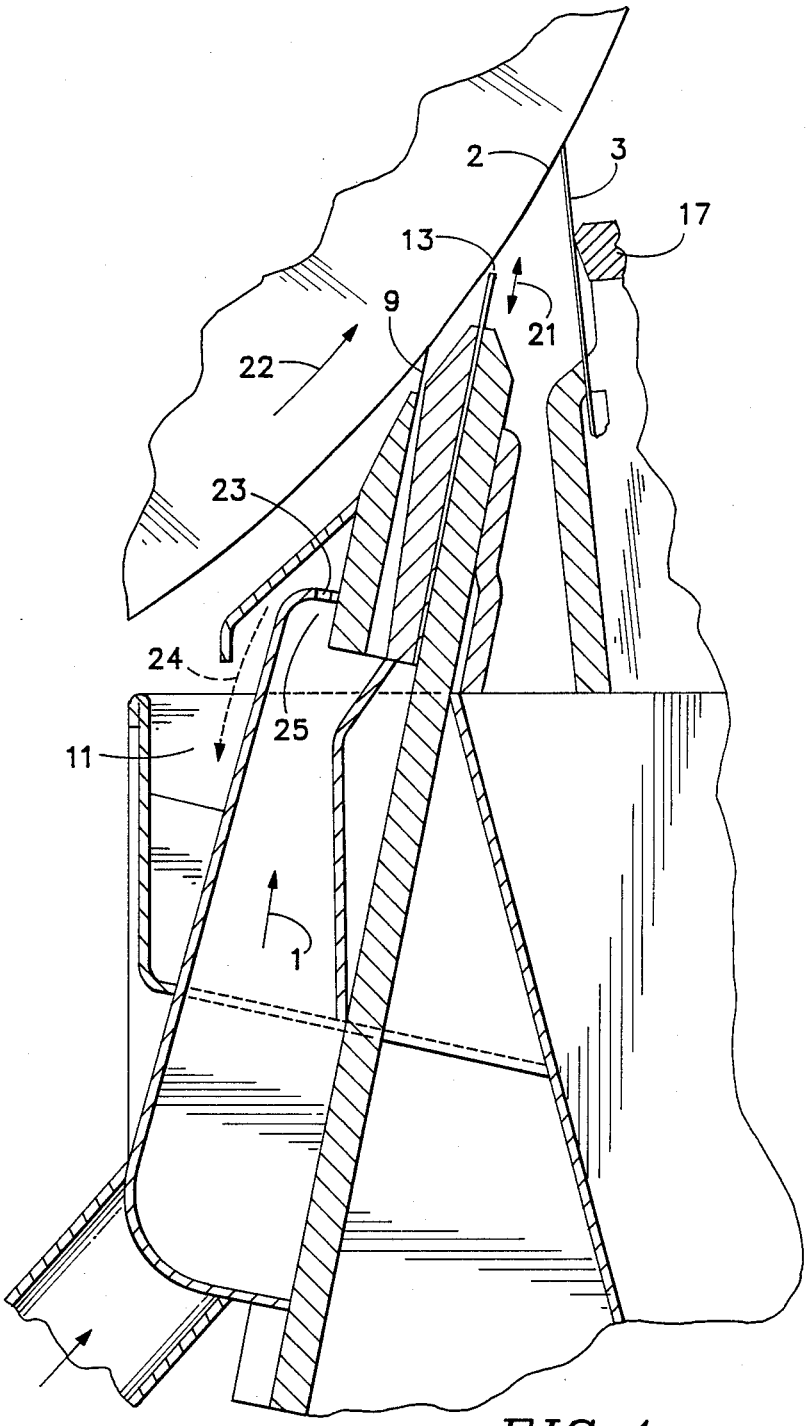
FIG. 4 illustrates a fourth embodiment of the invention in a side view.

In the embodiment according to FIG. 4, a cavity 25 is provided for collecting air bubbles formed in the paste and openings 23 are arranged in the inlet channel of the flowing paste for the separation of air bubbles from the paste. That amount of paste 24, which hereby follows along with the air bubbles, is collected in the container 11.

The invention is not limited to the embodiments shown, but several modification are feasible within the scope of the attached claims.

I claim:

1. Apparatus for coating a running web, e.g. of paper or cardboard, comprising a back-up member over which the web runs, and an applicator which defines a coating chamber which is open towards the web, the applicator including:

a rear wall structure which bounds the chamber in the upstream direction with respect to the path of movement of the web and is positioned relative to the web so as to prevent substantial flow of coating material from the chamber in the upstream direction, a front wall structure which bounds the chamber in the downstream direction and includes a doctor blade which engages the web, a fore distributor which is disposed between the rear wall structure and the front wall structure and is spaced from the web, means defining an inlet passage opening into the coating chamber on the upstream side of the fore distributor, the inlet passage being connected to a source of coating material under pressure, and means defining an outlet passage opening from the coating chamber on the downstream side of the fore distributor, and wherein the fore distributor prevents substantial flow of coating material from the inlet passage to the outlet passage except through the space between the for distributor and the web.

2. Apparatus according to claim 1, comprising a collection container for collecting coating material that flows from the coating chamber in the upstream direction.

3. Apparatus according to claim 1, wherein the fore distributor is adjustable in position relative to the back-up member, whereby the space between the fore distributor and the web is adjustable.

4. Apparatus according to claim 1, wherein the rear wall structure includes a sealing member which is adjustable relative to the back-up member between a first position in which it engages the web and a second position in which it is spaced slightly from the web and allows coating material to flow from the chamber at a low rate.

5. Apparatus according to claim 4, further comprising a collection container for collecting coating material that flows from the chamber in the upstream direction.

6. Apparatus according to claim 1, wherein the rear wall structure comprises a roll which engages the web.

7. Apparatus according to claim 6, wherein the roll is freely rotatable.

8. Apparatus according to claim 6, wherein the roll engages the web and the roll is driven so that its surface moves in the direction of movement of the web.

9. Apparatus according to claim 1, wherein the doctor blade o the front wall of the structure is inclined in the downstream direction.

10. Apparatus according to claim 1, comprising a collection container for collecting excess coating material removed from the web by the doctor blade of the front wall structure.

11. Apparatus according to claim 1, wherein the fore distributor comprises a replaceable scraper blade.

12. Apparatus according to claim 1, wherein the front wall structure is formed with a cavity for collecting air bubbles present in the coating material in the inlet passage, and with at least one opening for allowing the collected air bubbles to leave the inlet passage.

13. Apparatus according to claim 12, comprising a collection container for collecting coating material that leaves the inlet passage by way of the opening.

* * * * *